US006305393B1

(12) United States Patent
Lin

(10) Patent No.: US 6,305,393 B1
(45) Date of Patent: Oct. 23, 2001

(54) FLUSHING SYSTEM WITH PRESSURIZED AIR

(76) Inventor: Pang Chiech Lin, 7F, No. 46, Pin Ho 10 Street, Chang Hua 500 (TW)

( * ) Notice: Subject to any disclaimer, the term of this patent is extended or adjusted under 35 U.S.C. 154(b) by 0 days.

(21) Appl. No.: 09/434,752

(22) Filed: Nov. 4, 1999

(51) Int. Cl.[7] ..... B08B 9/00

(52) U.S. Cl. ..... 134/169 R; 134/169 R; 134/102.2

(58) Field of Search ..... 134/166 R, 167 R, 134/168 R, 168 C, 167 C, 169 R, 169 C, 166 C, 102.2, 109 A

(56) References Cited

U.S. PATENT DOCUMENTS

| | | | | |
|---|---|---|---|---|
| 1,799,105 | * | 3/1931 | Lasko | 134/166 R |
| 2,425,848 | * | 8/1947 | Vawter | 13/168 R |
| 2,554,389 | * | 5/1951 | Stevens | 134/167 R |
| 2,632,719 | * | 3/1953 | Tankersley | 134/102.2 |
| 3,431,145 | * | 3/1969 | Riley | 134/166 R |
| 3,536,081 | * | 10/1970 | Riess | 134/168 C |
| 3,566,892 | * | 3/1971 | Logue | 134/102.2 |
| 5,076,856 | * | 12/1991 | Schweiger | 134/169 C |
| 5,126,752 | | 6/1992 | Weinberg | 346/1.1 |
| 5,289,837 | * | 3/1994 | Betancourt | 134/169 A |
| 5,377,705 | | 1/1995 | Smith, Jr. et al. | 134/95.3 |
| 5,482,061 | * | 1/1996 | Bell | 134/169 A |
| 5,816,272 | * | 10/1998 | Leaphart | 134/102.2 |

* cited by examiner

*Primary Examiner*—Frankie L. Stinson

(57) ABSTRACT

A flushing system includes a tank for receiving a cleaning material, an object coupled to the tank for receiving the cleaning material from the tank, a container coupled to the object for receiving the cleaning material from the object, and a pressurized air supplying device for supplying a pressurized air into the tank to force the cleaning material into the object to clean the object. A control valve and a switch valve are coupled between the tank and the pressurized air supplying device and the container for selectively supplying the pressurized air into the tank and the container.

6 Claims, 3 Drawing Sheets

FLUSHING SYSTEM WITH PRESSURIZED AIR

BACKGROUND OF THE INVENTION

1. Field of the Invention

The present invention relates to a flushing and cleaning system, and more particularly to a flushing and cleaning system with pressurized air.

2. Description of the Prior Art

Two typical flushing systems are disclosed in U.S. Pat. No. 5,126,752 to Weinberg, and U.S. Pat. No. 5,377,705 to Smith, Jr. et al. The typical flushing systems comprise a pump or a motor provided for directly pumping the cleaning media, such as the gaseous material, the liquid, the cleaning agent, or the solvent. The typical flushing systems may not use the pressurized air to circulate the cleaning agent.

The present invention has arisen to mitigate and/or obviate the afore-described disadvantages of the conventional flushing systems.

SUMMARY OF THE INVENTION

The primary objective of the present invention is to provide a flushing system having a pressurized air source for providing the pressurized air to circulate the cleaning agent and to cleaning the objects.

In accordance with one aspect of the invention, there is provided a flushing system comprising a tank for receiving a cleaning material, an object to be cleaned being coupled to the tank for receiving the cleaning material from the tank, a container coupled to the object for receiving the cleaning material from the object, and means for supplying a pressurized air into the tank to force the cleaning material into the object to clean the object.

The tank and the container each includes a bottom portion coupled together for allowing the cleaning material to flow between the tank and the container. A check valve is further disposed between the tank and the container for preventing the cleaning material from flowing backward from the tank to the container. The tank includes means for indicating a level of the cleaning material received in the tank.

The pressurized air supplying means includes a pressurized air supplying device coupled to an inlet port of the tank for supplying the pressurized air into the tank. A control valve is further coupled between the tank and the pressurized air supplying device and coupled to the container for selectively supplying the pressurized air into the tank and the container. A switch valve is further coupled between the control valve and the pressurized air supplying device and coupled to the tank for selectively supplying the pressurized air into the tank and the pressurized air supplying device.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
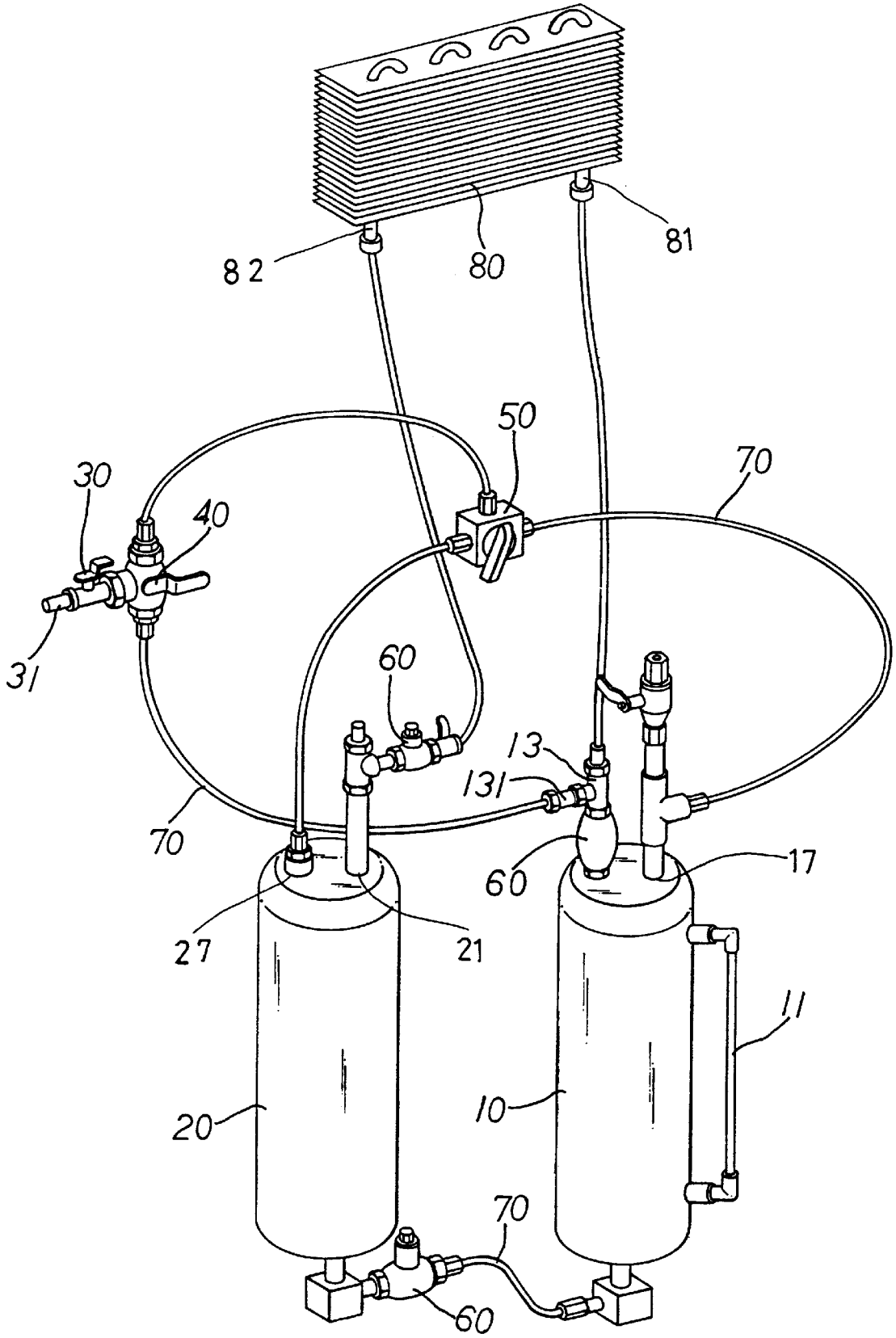
FIG. 1 is a perspective view of a flushing system in accordance with the present invention.
Figure 2:
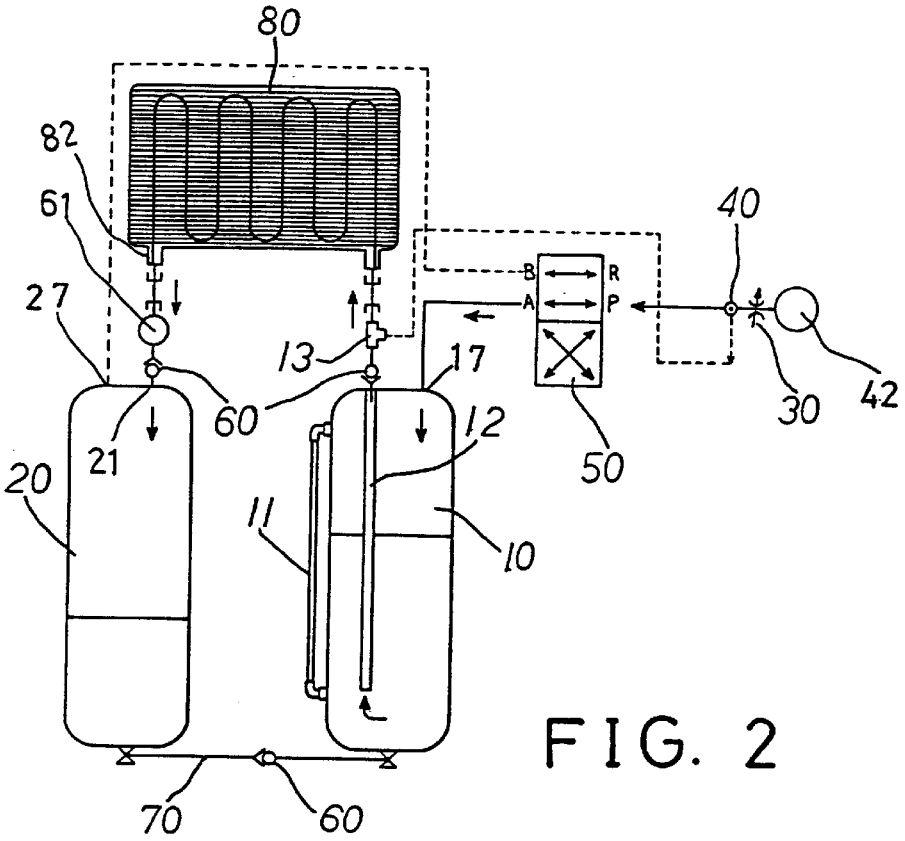
FIGS. 2, 3, 4, 5 are schematic views illustrating the operation of the flushing system.

Referring to the drawings, and initially to FIGS. 1 and 2, a flushing system in accordance with the present invention comprises a tank 10 for containing the cleaning materials, such as the liquid, the water, the cleaning agent, or the solvent, etc. The tank 10 includes a viewing or transparent tube communicating with the inner portion thereof for receiving the cleaning materials and for indicating the level of the cleaning materials contained in the tank 10. A tube 12 (FIGS. 2–5) is engaged into the tank 10 and has one end extended outward of the outlet of the tank 10 and coupled to an inlet 81 of an object 80, such as the condenser or the evaporator, to be cleaned, via a check valve 60 and a coupler 13, such as a three way coupler or valve 13. The cleaning materials contained in the tank 10 may be forced outward toward and through the object 80 via the check valve 60 and the coupler 13. The check valve 60 disposed between the bottom portions of the tank 10 and the container 20 may be removed for allowing the cleaning material to flow between the tank 10 and the container 20. However, it is preferable that the check valve 60 is provided to prevent the cleaning materials from flowing backward to the tank 10.

The object 80 includes an outlet 82 coupled to an entrance 21 of a container 20 via a check valve 60 and/or a filter 61 (FIG. 2) for allowing the cleaning materials from the object 80 to flow into and to be stored in the container 20 via the entrance 21 of the container 20. The check valve 60 may prevent the cleaning materials from flowing backward to the object 80. The bottom portions of the container 20 and the tank 10 are coupled together with a hose 70 or the like. A check valve 60 is disposed between the bottom portions of the container 20 and the tank 10 and is disposed in the hose 70 for directing the cleaning materials to flow from the container 20 to the tank 10 and for preventing the cleaning materials from flowing backward from the tank 10 to the container 20.

A control valve 50, such as a 4/2 way valve, is coupled to the inlet ports 17, 27 of the tank 10 and the container 20 with one or more hoses 70 and is disposed between the tank 10 and the container 20. A switch valve 40 is coupled between the control valve 50 and the tank 10 with one or more hoses 70. The switch valve 40 is coupled to one extension 131 of the coupler 13 for coupling to the tank 10 via the coupler 13. The switch valve 40 is coupled to a pressurized air reservoir or a pressurized air generator 42, such as an air pump or a compressor 42, via a valve 30, such as a control valve or a cut-off valve. The valve 30 includes an extension 31 coupled to the pressurized air reservoir or the pressurized air generator 42 for receiving the pressurized air therefrom.

Figure 5:
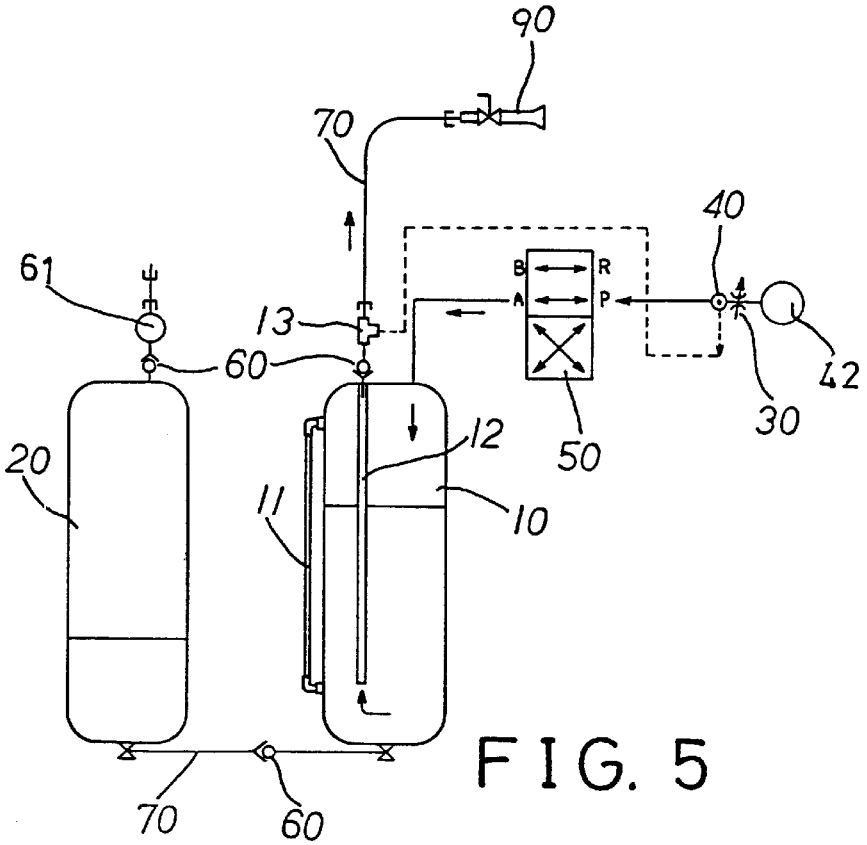

In operation, as shown in FIG. 2, when the switch valve 40 is switched and connected to the control valve 50 and when the control valve 50 is switched and connected to the inlet port 17 of the tank 10, the pressurized air from the pressurized air generator 42 may be supplied into the tank 10 to force the cleaning materials into the object 80 to clean the object 80. The cleaning materials may then be collected and received in the container 12. As shown in FIG. 5, when a sprayer device, such as a sprayer gun 90 is coupled to the coupler 13, the cleaning materials may be discharged from the sprayer gun 90 to clean the outer portions of the object 80.

Figure 3:
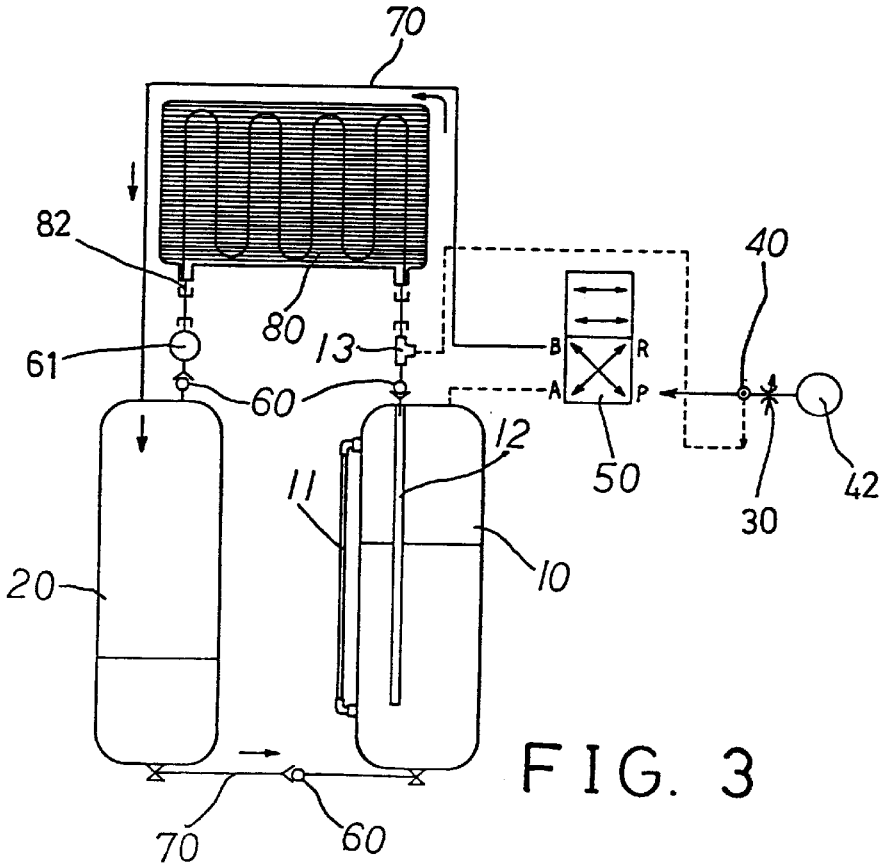

As shown in FIG. 3, when the control valve 50 is switched and connected to the inlet port 27 of the container 20, the pressurized air from the pressurized air generator 42 may be supplied into the container 20 to force the cleaning materials from the container 20 to the tank 10. The cleaning materials may thus be forced backward and collected and received in the tank 10 for further use.

Figure 4:
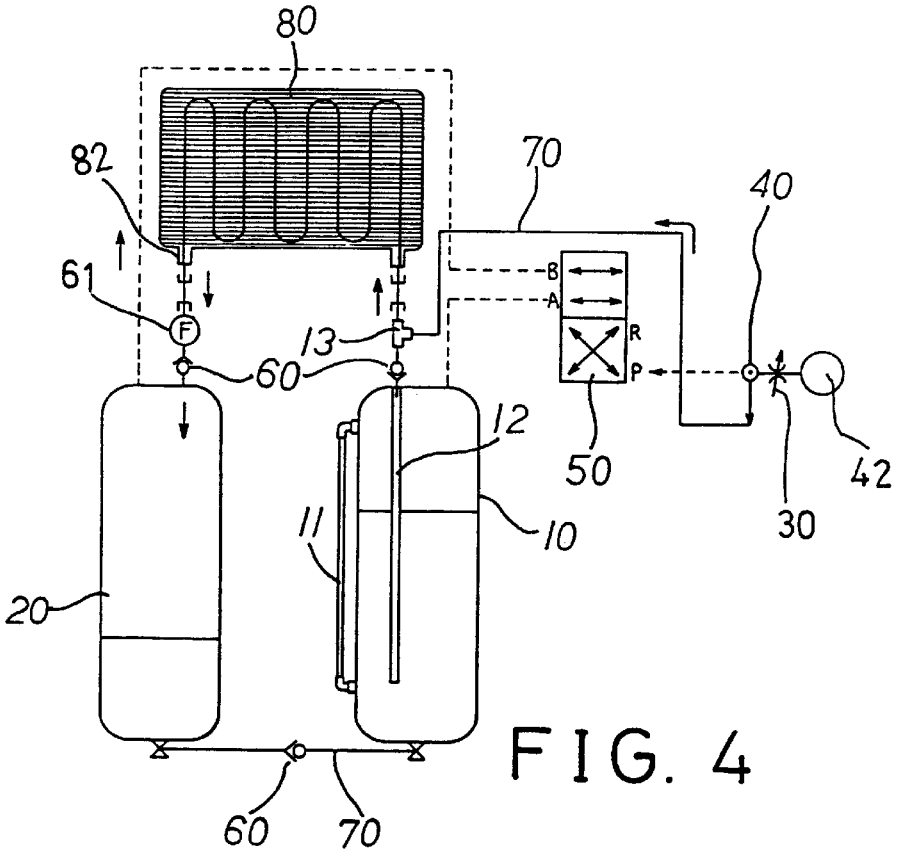

As shown in FIG. 4, when the switch valve 40 is switched and connected to the coupler 13, but not to the control valve

50, the check valve 60 coupled between the coupler 13 and the tank 10 may prevent the pressurized air from flowing into the tank 10 such that the pressurized air may be forced and supplied into the object 80 to clean the inner portion of the object 80. Similarly, as shown in FIG. 5, at this moment, when the sprayer gun or when a nozzle is coupled to the coupler 13, the pressurized air may be discharged from the nozzle to clean the outer portion of the object 80.

Accordingly, the flushing system in accordance with the present invention includes a pressurized air source for providing the pressurized air to circulate the cleaning agent and to cleaning the objects.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A flushing system comprising:

a tank for receiving a cleaning material, an object to be cleaned being coupled to said tank for receiving the cleaning material from said tank, means for supplying a pressurized air into said tank to force the cleaning material into said object to clean said object, a container coupled to said object for receiving the cleaning material from said object, and a control valve coupled between said tank and said pressurized air supplying means and coupled to said container for selectively supplying the pressurized air into said tank and said container.

2. The flushing system according to claim 1, wherein said tank and said container each includes a bottom portion coupled together for allowing the cleaning material to flow between said tank and said container.

3. The flushing system according to claim 2 further comprising a check valve disposed between said tank and said container for preventing the cleaning material from flowing backward from said tank to said container.

4. The flushing system according to claim 1, wherein said tank includes means for indicating a level of the cleaning material received in said tank.

5. The flushing system according to claim 1, wherein said pressurized air supplying means includes a pressurized air supplying device coupled to an inlet port of said tank for supplying the pressurized air into said tank.

6. The flushing system according to claim 1 further comprising a switch valve coupled between said control valve and said pressurized air supplying means and coupled to said tank for selectively supplying the pressurized air into said tank and said pressurized air supplying means.

* * * * *